US005423153A

United States Patent [19]

Woolems et al.

[11] Patent Number: 5,423,153

[45] Date of Patent: Jun. 13, 1995

[54] SIMULATED LOG SIDING FOR BUILDINGS

[76] Inventors: Brent E. Woolems, R.R. #1, Box 145 B; Philip E. Woolems, R.R. #1, Box 56 A, both of English, Ind. 47118

[21] Appl. No.: 91,121

[22] Filed: Jul. 14, 1993

[51] Int. Cl.[6] ..... E05B 1/10

[52] U.S. Cl. ..... 52/233; 52/514; 52/520; 52/539; 52/541; 52/573.1

[58] Field of Search ..... 52/233, 591.4, 592.1, 52/592.6, 541, 551, 536, 313, 531, 533, 554, 520, 539, 573.1, 514, 522, 529, 546

[56] References Cited

U.S. PATENT DOCUMENTS

| | | | |
|---|---|---|---|
| 430,187 | 6/1890 | Kendall | 52/541 |
| 1,654,120 | 12/1927 | Ewing | 52/233 |
| 2,250,764 | 7/1941 | Hoess | 52/520 |
| 2,402,876 | 6/1946 | Dennis | 52/233 |
| 3,849,960 | 11/1974 | Henry et al. | 52/233 X |
| 3,852,933 | 12/1974 | Guzzo | 52/533 |
| 4,012,876 | 3/1977 | Gruobbs | 52/233 |
| 4,047,349 | 9/1977 | Aguilar | 52/546 X |
| 4,047,350 | 9/1977 | Chisum | 52/233 X |
| 4,104,841 | 8/1978 | Naz | 52/55 X |
| 4,154,040 | 5/1979 | Pace | 52/531 X |
| 4,272,576 | 6/1981 | Britson | 52/551 X |
| 4,292,781 | 10/1981 | Chalmers et al. | 52/551 X |
| 4,435,938 | 3/1984 | Rutkowski et al. | 52/546 X |
| 4,450,665 | 5/1984 | Katz | 52/522 |
| 4,878,328 | 11/1989 | Berge | 52/233 |
| 5,060,432 | 10/1991 | Christian | 52/233 |
| 5,074,093 | 12/1991 | Meadows | 52/520 X |
| 5,181,358 | 1/1993 | Mead | 52/233 |
| 5,271,878 | 12/1993 | Mizia et al. | 52/233 X |

FOREIGN PATENT DOCUMENTS

| | | | |
|---|---|---|---|
| 0224929 | 10/1991 | Japan | 52/233 |

*Primary Examiner*—Carl D. Friedman
*Assistant Examiner*—Robert J. Canfield
*Attorney, Agent, or Firm*—Maurice L. Miller, Jr.

[57] ABSTRACT

A simulated log siding for a cabin, house or other building is disclosed which can be constructed of tree heartwood, such as oak, or vinyl plastic. In the heartwood species, elongated planks are provided which have an outwardly bowed outer facing surface and a flat inwardly facing surface. Each plank contains a notched inwardly facing lower edge and a rail extending along an upper edge of the outwardly bowed surface. The rail of a lower row of such planks inserts into the rabbet joint of an immediately adjacent upper row of such planks to provide a moisture barrier between adjoining rows. In the vinyl plastic species elongated planks are provided which also have an outwardly bowed outer facing surface. A flat panel is attached along an upper edge of the bowed surface which contains an outwardly projecting, downwardly opening catch channel or member. The base of each plastic plank is flat and contains an upwardly projecting flange which fits into the catch channel of an immediately lower row of such planks to provide an overlapping virtually water tight seal between such rows.

11 Claims, 5 Drawing Sheets

SIMULATED LOG SIDING FOR BUILDINGS

BACKGROUND OF THE INVENTION

This invention relates to simulated log siding for cabins, houses and other buildings. More specifically, this invention relates to such siding when constructed of tree heartwood and of relatively rigid forms of vinyl plastic.

Broadly speaking, simulated log siding for buildings which is constructed of planks of tree heartwood has long been known in the prior art. See the half-log wall construction disclosed in U.S. Pat. No. 4,012,876 issued to G. B. Grubbs on Mar. 22, 1977. One difficulty with this construction is the existence of an upwardly opening rabbet along an upper edge portion of each plank of siding into which moisture can readily penetrate to cause rotting of the wood and damage to insulation sheeting against which the log siding may be placed. Another simulated log siding is disclosed in U.S. Pat. No. 1,654,120 issued to C. A. Ewing on Dec. 27, 1927. Seepage of moisture between adjoining wood planks is also a problem in this type of construction, although the seepage of moisture between the planks and behind the assembly is avoided.

We are not aware of the existence in the prior art of simulated log siding employing vinyl plastic planks. However, an extruded plastic architectural tile which is intended to create the appearance of clay tiles and cedar-shake shingles is disclosed in U.S. Pat. No. 5,074,093 issued to D. F. Meadows on Dec. 24, 1991. But this structure does not give the appearance of or simulate log siding.

By means of our invention a simulated log siding is provided which substantially overcomes these and other difficulties encountered in the prior art.

SUMMARY OF THE INVENTION

It is an object of our invention to provide a simulated log siding for a cabin, house or other building.

It is also an object of our invention to provide simulated log siding constructed of tree heartwood.

It is another object of our invention to provide simulated log siding constructed of vinyl plastic material.

Briefly, in accordance with one species of our invention, we provide a wood plank for use in forming simulated log siding for a building. The plank includes an outwardly bowed surface, a flat base and an inverted L-shaped rabbet formed in and along a lower edge portion of the inner surface. The plank also includes an elongated rail of rectangular cross-section attached to and projecting upwardly from an upper edge of the lowest surface. Also included is means for inhibiting the formation of cracks in the outer surface as a result of expansion and contraction of the plank.

In accordance with a second species of our invention we provide a vinyl plastic plank for use in forming simulated log siding for a building. The plastic plank includes an elongated, outwardly bowed sheet and an elongated flat panel attached to and projecting upwardly along an upper edge of the bowed sheet. The subject panel also includes an elongated outwardly projecting and downwardly opening catch member attached to and extending horizontally along the panel for attachment to a base portion of a first longitudinally adjacent plank. A base portion is attached to and along a base edge of the bowed sheet and includes an elongated flange projecting upwardly behind the bowed sheet for engagement with a catch member of a second longitudinally adjacent plank.

These and other objects, features and advantages will become apparent to those skilled in the art from the following detailed description and attached drawings upon which, by way of example, only the preferred embodiments of our invention are described and illustrated.

DESCRIPTION OF THE PREFERRED EMBODIMENTS

Figure 1:
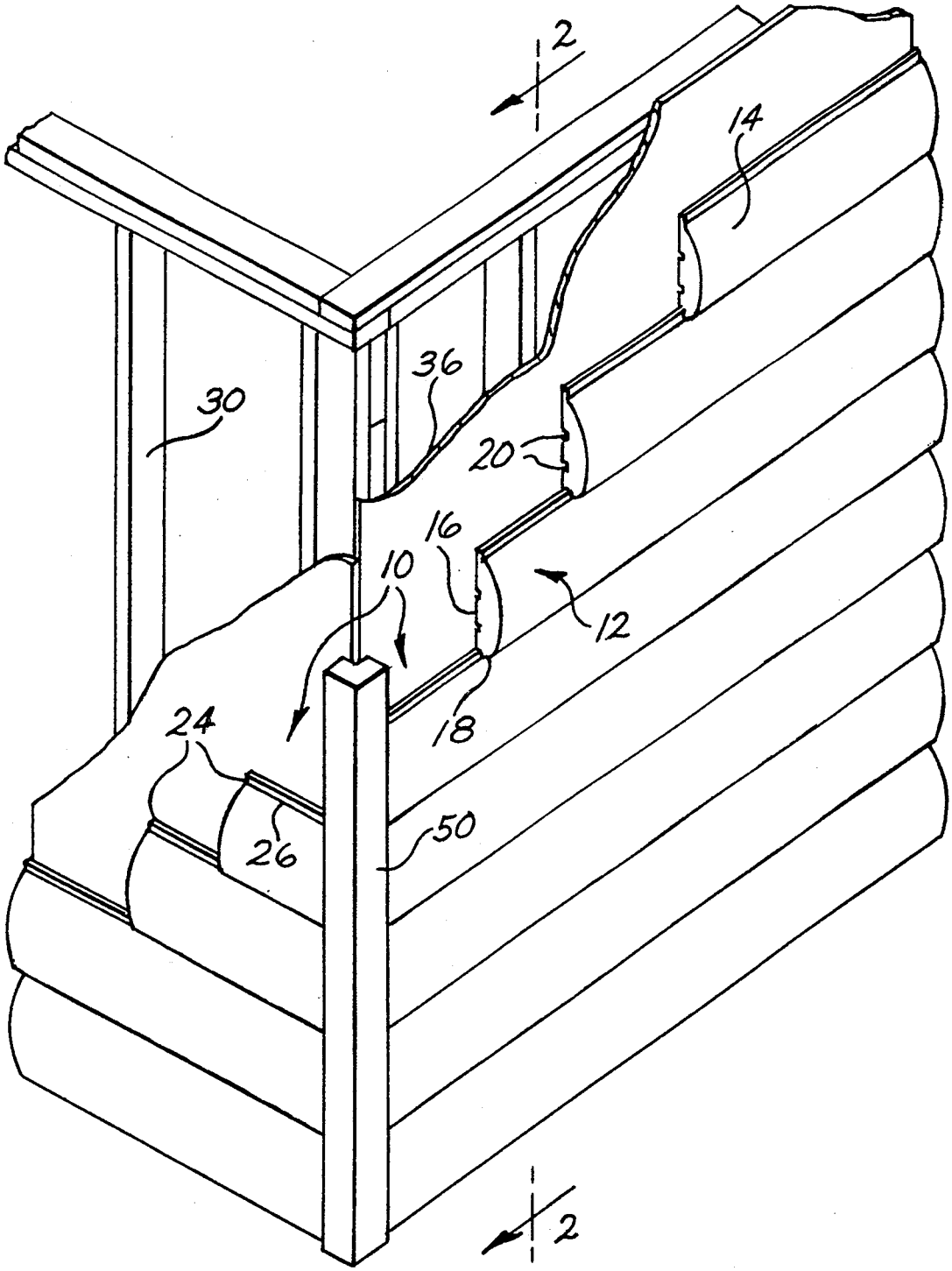
FIG. 1 shows a perspective view of a comer portion of a building containing simulated log siding made of tree heartwood and having portions tom away for viewing clarity, thus illustrating a preferred embodiment of one species of our invention.
Figure 2:
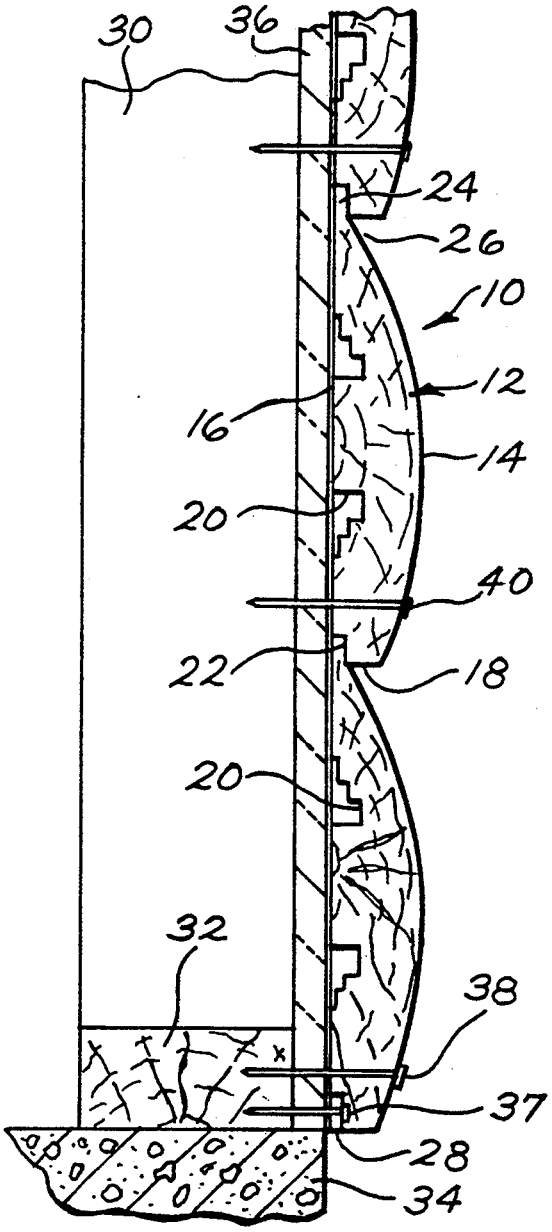
FIG. 2 shows a cross-sectional end elevation view of one of the exterior walls of the building of FIG. 1 as viewed along cross-section lines 2—2 of the latter figure and with foundation portions added.

Referring now to the drawing figures and, in particular, FIGS. 1–2 there is shown, in a preferred embodiment of our invention, a simulated log siding, generally designated 10, for attachment to the exterior walls of a cabin, residential house or other building. In the present example, the siding comprises a series of elongated planks 12 mounted longitudinally adjacent one another to form horizontally extending rows. The planks 12 are preferably formed of oak tree heartwood, for which we find white oak to be a particularly attractive variety.

Each of the planks 12 includes an outwardly bowed outer facing surface 14, a flat inwardly facing surface 16, and a flat lower edge or base 18. A pair of elongated, spaced apart grooves 20 are formed in an inwardly facing surface portion of each plank 12, which grooves 20 extend horizontally from one end of each plank to the other. The grooves 20 permit the planks 12 to expand and contract as a result of substantial changes in the moisture content of the wood, which changes occur with changes in temperature and humidity from week to week and from season to season. The grooves 20 permit expansion and contraction of the wood while inhibiting the formation of unsightly cracks in the viewable, outer facing surface 14. Although we have not tested it, we believe that a single such groove 20 per plank may be sufficient for this purpose.

The planks 12 are adapted to interfit with one another in the following manner. An inverted, L-shaped notch or rabbet joint 22 is formed in an inwardly facing surface portion of the surface 16 so as to extend along a lower edge portion from one end to the other of each of the planks 12. The upper end of each plank 12 is formed into a horizontally extending rail 24 of rectangular cross-section as viewed looking into the end of the plank as in FIG. 2. The rail 24 thus projects upwardly from a longitudinally extending upper edge 26 of the bowed outer facing surface 14.

In the present example, the width of the rabbet joint 22 at the base of each plank 12 is approximately equal to the thickness of the rail 24 on each plank, the rail 24 of one plank 12 being inserted into the rabbet joint 22 of the next higher longitudinally adjacent plank. The rabbet joint 22 of the lowest row of planks 12 fits onto an elongated starter strip 28 which has a similar rectangularly shaped cross-section as viewed in FIG. 2. The depth of each rabbet joint 22 is essentially equal to the height of the rail 24 of the plank 12 which fits therein so that the fiat base 18 of each row of planks 12 extends along an edge 26 of an immediately lower row, except as to the lowest row of planks 12 wherein the depth of the rabbet joint 22 is approximately equal to the height of the starter strip 28.

The wall against which the planks 12 are placed may be of conventional construction such as, for example, a series of vertically extending 2 inch×4 inch wall studs 30, adjacent one of which are horizontally spaced apart on 16 inch centers. Conventionally, such studs are mounted on an elongated, horizontally extending 2 inch×4 inch plate 32 which, in turn, rests upon and along a concrete foundation wall or footer 34. Sheets 36 of insulation are then nailed to the exterior facing surfaces of the outside wall studs 30. Next, the starter strip 28 is nailed at various positions along its length, as at 37 in FIG. 2, through the insulation sheet 36 to and along an outwardly facing portion of the plate 32. A first or lower row of the planks 12 is then placed with the fiat surface 16 against the insulation sheet 36 so that the rabbet joint 22 of that row rests on and along the starter strip 28. With the rail 24 of this lower row of planks 12 placed flush against the insulation sheet 36, the planks 12 of the lower row are nailed as at 38 on a base portion thereof just above the starter strip 28 through the insulation sheet 36 to a mid-level of the plate 32.

Thereafter, a second row of the planks 12 is placed so that the rabbet joints 22 thereof rest on and along the rail 12 of the lowest row of planks 12 and the second row of planks are nailed as at 40 along a base portion thereof just above the rail 24 of the lower row of planks upon which they rest, through the sheet 36, and into each of the horizontally spaced apart wall studs 30. Each successively higher row of planks 12 is secured to the wall studs 30 in the same manner so that the rabbet joint 22 of each successively higher row rests upon and along the rail 24 of the immediately lower row of planks. Accordingly, the siding is placed in adjoining horizontally extending rows in this manner and is built from the starter strip 28 upwardly to the upper edge of the exterior wall until the insulation sheet 36 and wall studs 30 are essentially covered. We recommend using No. 8 nails which are driven at least one inch into the plate 32 to secure the starter strip 28 to the latter, which nails may be spaced apart on 16 inch centers or at any other suitable distances apart. The siding nails 38, 40 which we prefer to use to secure the planks 12 to the wall studs 30 are No. 16 nails, 3 inches in length. The nails 37, 38 and 40 should in each case be of sufficient length to extend at least one and one-half inches into the plate 32 and studs 30, as the case may be.

The inverted L-shaped notches which form the rabbet joints 22 rest against the upwardly projecting rails 24 so as to prevent moisture, blowing rain, melting snow and the like from seeping upwardly against the force of gravity between the notches and corresponding rails. By providing such a stair step joint, moisture is prevented from finding its way onto the upper surface of the rails 24 and thence downwardly between the insulation sheet 36 and the flat surfaces 16 of the planks 12. In this way, rotting of the siding by means of standing water or excessive moisture trapped between the sheet 36 and the surfaces 16 is greatly inhibited.

Figure 3:
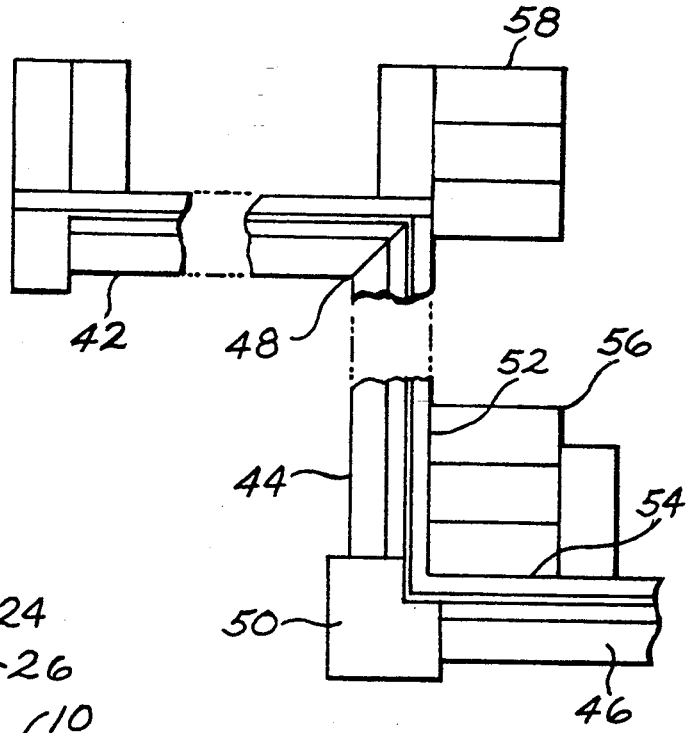
FIG. 3 shows a plan view of an exterior wall segment of the building of FIG. 1 illustrating the formation of inside and outside comers using the siding of the latter figure.

Referring now to FIG. 3, arrangement of the siding of the present example at various comers of a building is shown. A row containing planks 42, 44 and 46 similar to the planks 12 of FIGS. 1–2 is shown. The planks 42 and 44 abut one another along a 45 degree miter 48 to form an inside comer, while the planks 44 and 46 terminate into a post 50 of square cross-section situated at an outside comer. The post 50 contains a vertically extending 90 degree notch on its inside comer so as to fit flush into an outside comer formed by two adjacent insulation sheets 52 and 54. Both the outside and inside comers are braced by posts 56 and 58, respectively, each of which is constructed of 2 inch×4 inch boards arranged as shown.

Figure 4:
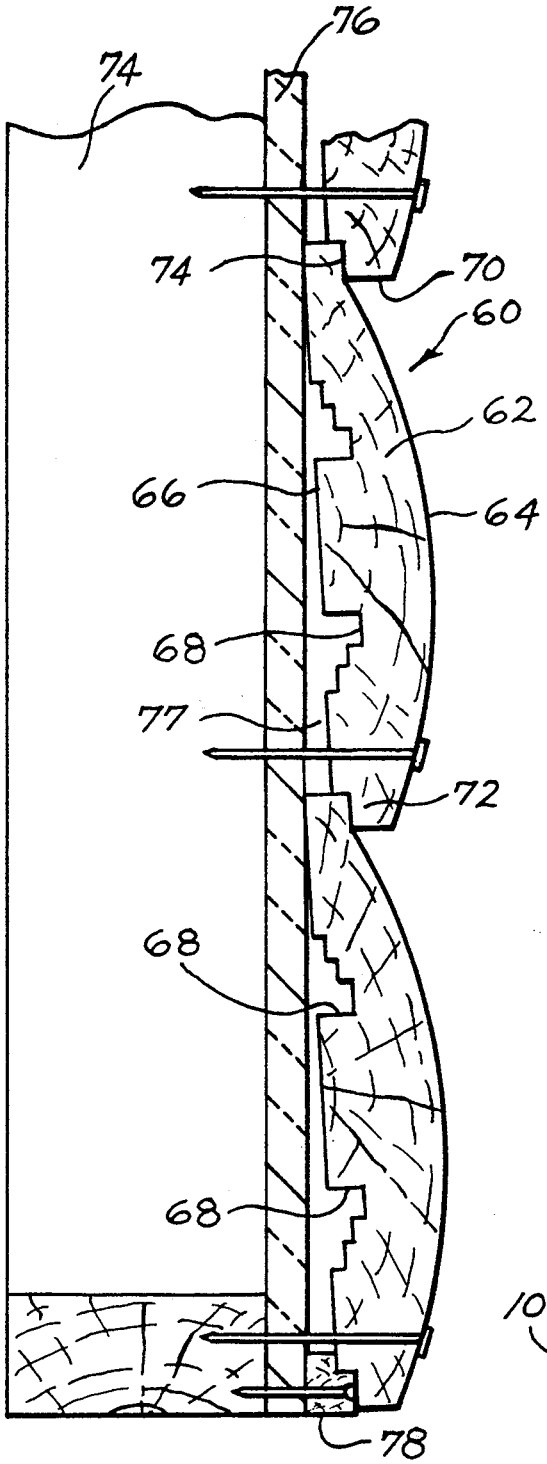
FIG. 4 shows a cross-sectional end elevation view of the exterior wall of a building illustrating a modification of the same species of siding as shown in FIGS. 1–3.

Referring now to FIG. 4, there is shown in another embodiment of our invention a simulated log siding, generally designated 60, for a house or other building. The siding 60 is also of suitable heartwood construction and contains planks 62 which are generally similar to the planks 12 of the previous example in that they each contain an outwardly bowed face 64, a flat back 66 containing a pair of vertically spaced apart, horizontally extending grooves 68, a fiat base 70 and an elongated rail member 72 of rectangular cross-section as viewed, which projects upwardly from an upper edge of the outwardly bowed face 64. The conventional supporting wall against which the siding 60 is placed, including a plurality of spaced apart, vertically extending wall studs 74 and insulation sheeting 76, is similar to that of the previous example.

In the present example, the width of the rail 72 of each of the planks 60 is two to three times the width of the corresponding rabbet joint 74 such that the back 66 is tilted diagonally outwardly and downwardly away from the wall studs 74 and insulation sheet 76. This provides an air space 77 between a substantial portion of the back 66 of each of the planks 60 and the insulation sheet 76 to increase the insulation value of the assembly over that of the previous example. In this example, an L-shaped starter strip 78 is provided which is notched along an upper outer edge portion thereof so that the lowest row of the planks 60 resting thereon will also be tilted relative to the wall studs 74 and insulation sheet 76. The planks 62 are affixed to the wall studs 74 by means of nails 79 driven into the wall studs 74 just above the nearest rails 72 as explained in the previous example.

Figure 5:
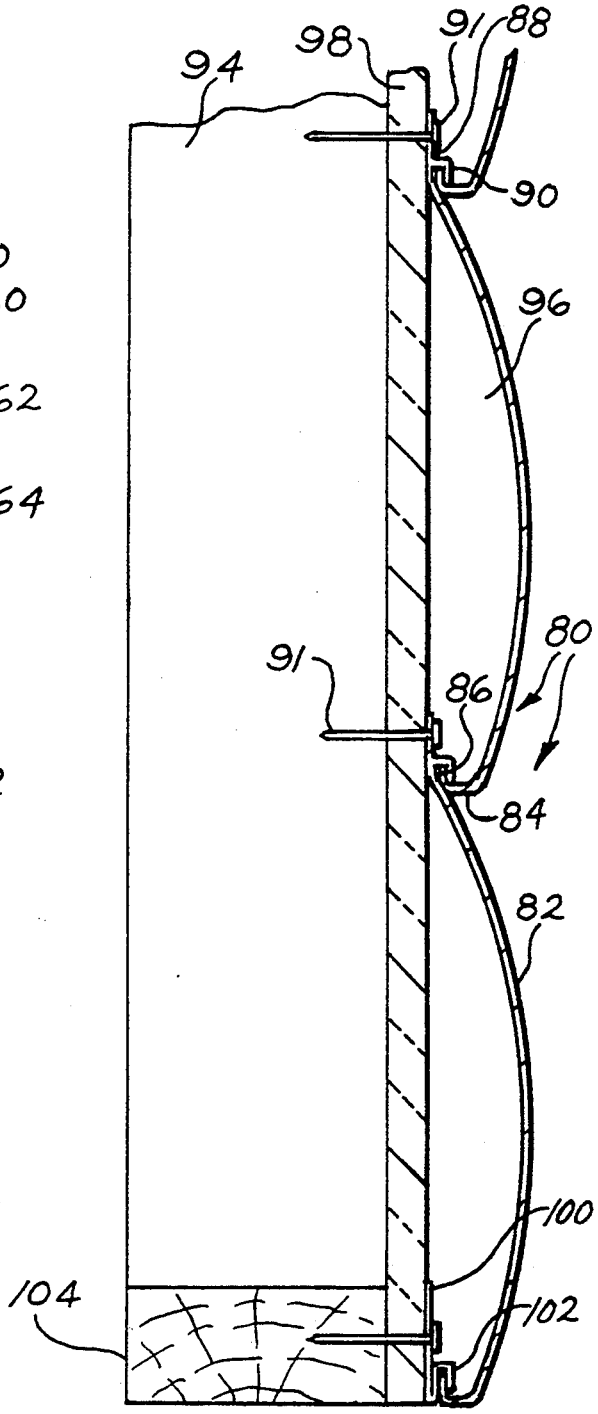
FIG. 5 shows a cross-sectional end elevation view of a building containing simulated log siding made of vinyl plastic, thus illustrating a preferred embodiment of a second species of our invention.
Figure 6:
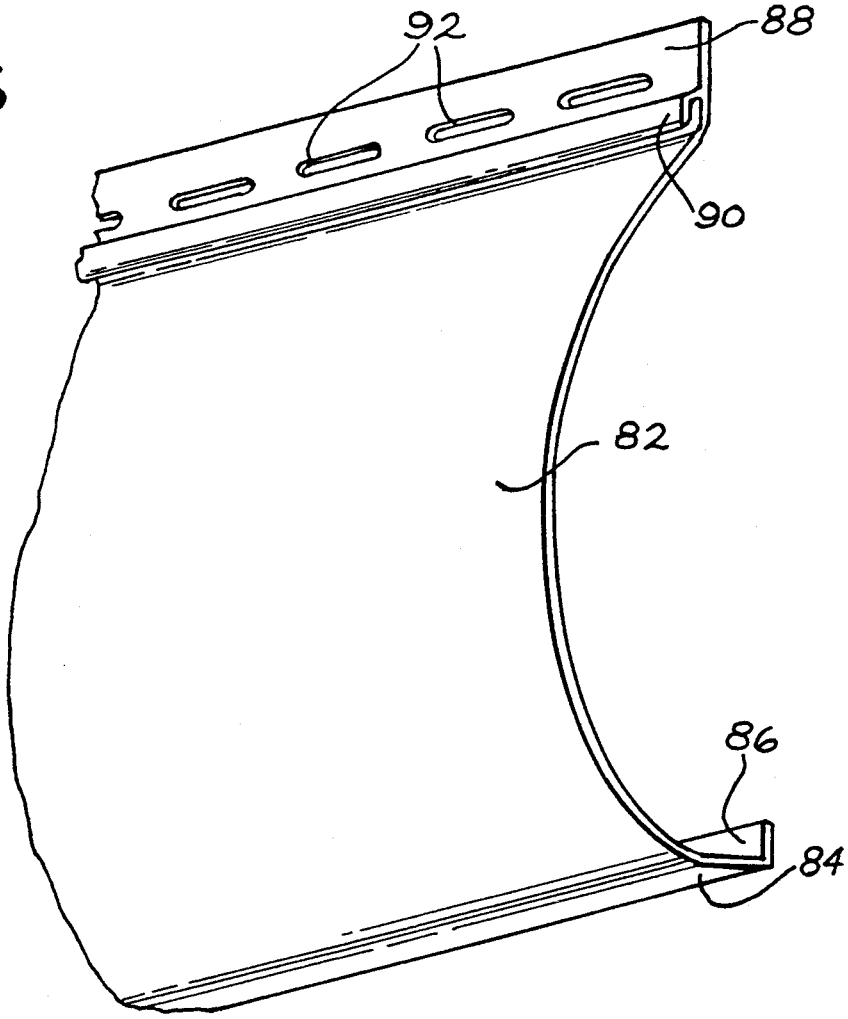
FIG. 6 shows a perspective view of a portion of the siding shown in FIG. 5.
Figure 7:
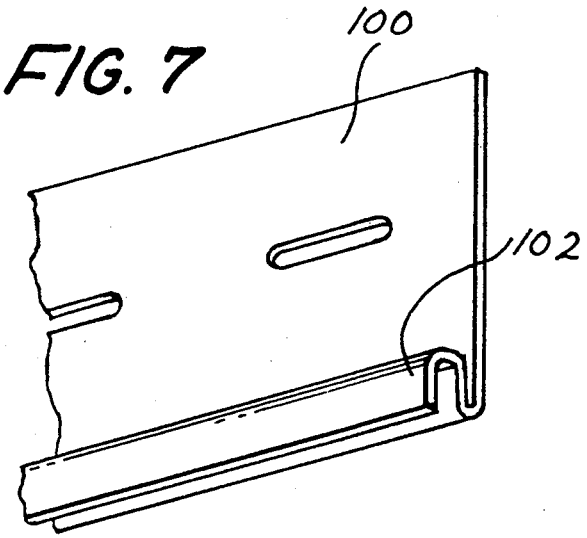
FIG. 7 shows a perspective view of a portion of a starter strip as also shown in FIG. 5.
Figure 8:
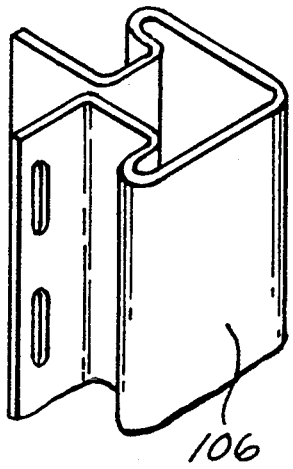
FIG. 8 shows a vinyl plastic post made for use on an outside comer of adjoining exterior walls of a building upon which the siding of FIG. 5–6 is used.

Referring now to FIGS. 5–8, there is shown in yet another embodiment of our invention, a simulated log siding 80 for the exterior walls of a building which includes a series of elongated planks 82 constructed of a suitable rigid vinyl plastic material. The planks 82 contain a outwardly bowed outer facing surface, a flat base 84, and a flange 86 projecting upwardly from a back edge of the base 84. An elongated panel 88 extends upwardly from an upper edge of the outwardly bowed surface 82 and contains an elongated downwardly opening catch member 90 of inverted L-shaped cross-section as viewed in FIG. 5, into which the flange 86 of the next higher row of planks 82 is inserted. The panel 88 contains a series of elongated, spaced apart nail slots 92 as shown in FIG. 6 to insure that nails 91 can be driven through a slot which is located opposite each of the spaced apart wall studs 94 of an exterior wall of a building to which the siding 80 is being installed. The outwardly bowed planks 82 give the appearance of log construction and also provide an airspace 96 next to an insulation sheet 98 applied to the outward facing surfaces of the studs 94. It will be noted here that, contrary to the previous examples, the planks 82 are secured to wall studs along their upper edges. A metal or vinyl starter strip 100 having an S-shaped lower edge portion 102 as shown in FIGS. 5 and 7 may be nailed to a plate 104 for engagement with the flange 86 of the lowest row of the planks 82. The upwardly projecting flanges 86, inserted as they are into the catch members 90, also provide an effective barrier against the seepage of moisture upwardly against the force of gravity into the airspace 96 similar to the stair step joints formed by the rabbets 22 and their corresponding rails 24 of the first preceding example. A vinyl post 106 such as shown in FIG. 8 can be used to form outside comers for the planks 82. In the alternative, a post such as shown at 50 in FIGS. 1 and 3 can be used for this purpose. As in FIG. 3, adjacent ones of the vinyl planks 82 may be mitered to form inside comers for the assembly 80.

When two or more rows of the planks 80 are assembled as shown, for example, in FIG. 5, the flat base 84 tends to cast a shadow on an upper surface portion of a longitudinally adjacent plank located immediately below that flat base. While this gives a pleasing appearance .to the assembly and is, for that reason, preferred, the flat base 84 is not essential. That is to say, the flange 86, which is essential, can be attached directly to the lower edge of each bowed sheet so as to project upwardly behind the bowed surface to connect to the catch member of a lower row of planks.

Figure 9:
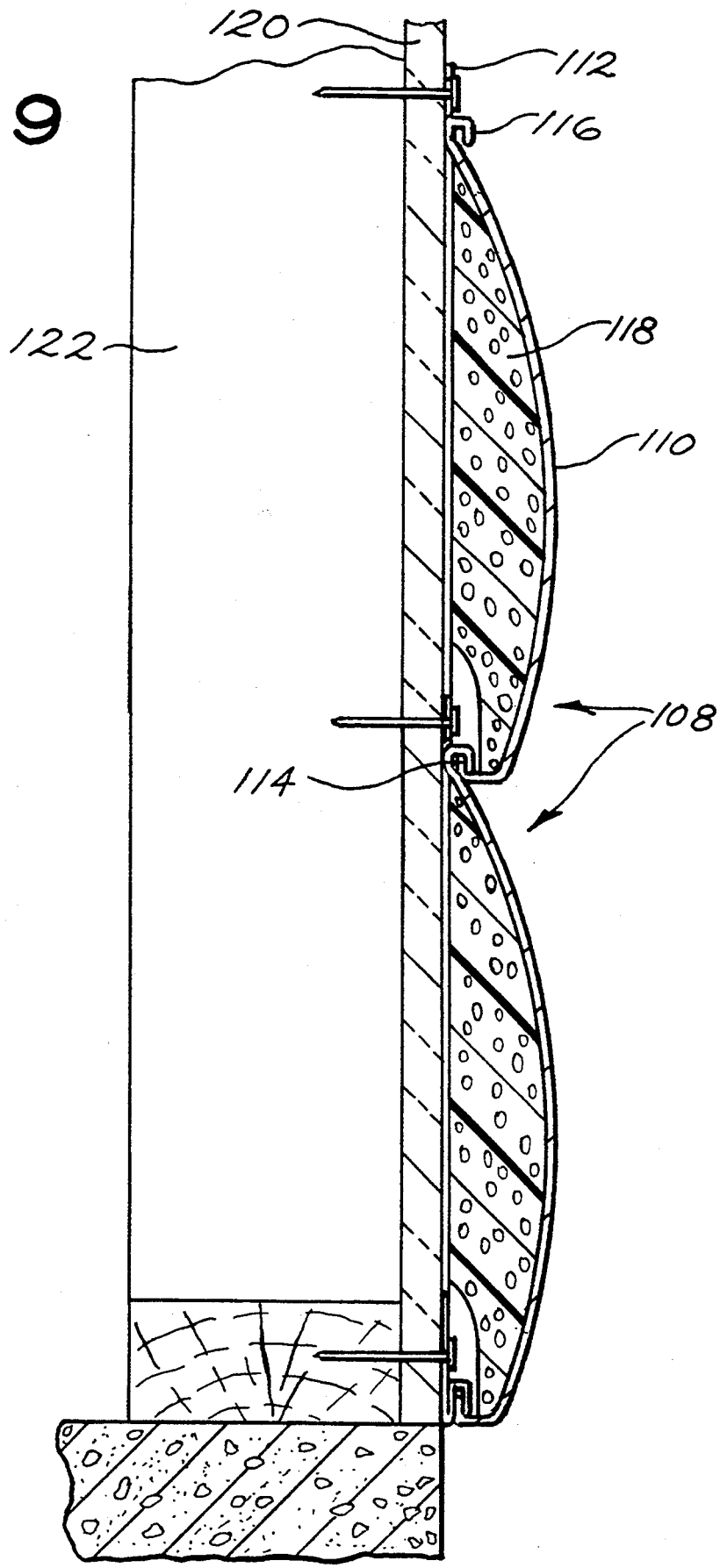
FIG. 9 shows a cross-sectional end elevation view of simulated log siding made of styrofoam filled vinyl plastic thus illustrating an alternative embodiment of the second species of our invention.

Referring now to FIG. 9 there is shown a modified form of the vinyl plastic siding of the previous example. The siding is formed by horizontally extending rows of planks 108 each of which includes an outwardly bowed viewable surface 110, a fiat panel 112 attached to and along an upper edge of the bowed surface 110 and a base portion including an elongated, upwardly projecting flange 114. The flanges 114 fit into elongated downwardly opening catch members 116 located on the flat panels 112 of longitudinally adjacent planks. A mass of styrofoam, polystyrene or other suitable insulation material 118 is applied to the inwardly facing, concave surface of the vinyl plastic sheet 110 so that the sheet 110 rests flush against the insulation sheet 120 attached to the exterior facing surface of wall studs 122. Thus, it will be apparent that the vinyl plastic siding of the previous example may contain an air space, as at 96 in FIG. 5, or, in the alternative, may be filled with a suitable insulation material such as styrofoam as shown at 118 in FIG. 9.

Although the present invention has been described with respect to specific examples of certain preferred embodiments thereof it is not intended that such details limit the scope of this patent other than as specifically set forth in the following claims.

We claim:

1. Simulated log siding for a building comprising a plurality of planks arrangable in horizontally extending rows aligned one above another against a vertical building supporting structure, each of said planks including an outwardly bowed outer surface, a flat inner surface, a fiat base, an inverted L-shaped rabbet formed in and along a lower, inner surface portion of said inner surface, and a rail which is rectangularly shaped as viewed in end cross-section of each of said planks, said rail being attached to and projecting upwardly from an upper outer edge of said outwardly bowed surface for insertion in close fitting relation in and along the rabbet of an overlying one of said planks such that the fiat base of said overlying one of said planks projects outwardly from and along an upper outer edge of the outwardly bowed surface of the next lower row of said planks.

2. The siding of claim 1 wherein each of said planks is constructed of wood and contains means for inhibiting the formation of cracks in said bowed surface as a result of expansion and contraction of said planks.

3. The siding of claim 1 wherein the thickness of said rail on each of said planks is substantially greater than the thickness of each said rabbet in each of said planks such that each of the flat inner surfaces of said planks which overlies another of said planks is tilted diagonally relative to said supporting structure to provide an airspace between each of said planks and said supporting structure.

4. The siding of claim 1 wherein said planks are constructed of tree heartwood.

5. The siding of claim 1 further comprising an elongated starting strip adapted to fit in and along a rabbet of a lowest row of said planks and be secured against said supporting structure.

6. The siding of claim 2 wherein said means comprises at least one groove formed in and along a flat, inner surface portion of said planks.

7. The siding of claim 4 wherein said planks are constructed of oak heartwood.

8. A wood plank for use in forming simulated log siding for a building comprising an outwardly bowed outer surface, a flat inner surface, a flat base, an inverted L-shaped rabbet formed in and along a lower edge portion of said inner surface, an elongated rail of rectangular cross-section attached to and projecting upwardly from an upper edge of said bowed surface, and means for inhibiting the formation of cracks in said bowed surface as a result of expansion and contraction of said plank.

9. Simulated log siding for a building comprising a plurality of planks arrangable in horizontally extending rows aligned one above another against a vertical building supporting structure, each of said planks including an outwardly bowed outer surface, a flat inner surface, a flat base, an inverted L-shaped rabbet formed in and along a lower, inner surface portion thereof, and a rail which is rectangularly shaped as viewed in end cross-section of each of said planks, said rail being attached to and projecting upwardly from an upper edge of said outwardly bowed surface for insertion in close fitting relation in and along the rabbet of an overlying one of said planks such that the fiat base of said overlying one of said planks projects outwardly from and along an upper edge of the outwardly bowed surface of the next lower row of said planks, said planks being constructed of wood and including means for inhibiting the formation of cracks in said bowed surface as a result of expansion and contraction of said planks.

10. Simulated log siding for a building comprising a plurality of planks arrangable in horizontally extending rows aligned one above another against a vertical building supporting structure, each of said planks including an outwardly bowed outer surface, a flat inner surface, a flat base, an inverted L-shaped rabbet formed in and along a lower, inner surface portion thereof, and a rail which is rectangularly shaped as viewed in end cross-section of each of said planks, said rail being attached to and projecting upwardly from an upper edge of said outwardly bowed surface for insertion in close fitting relation in and along the rabbet of an overlying one of said planks such that the flat base of said overlying one of said planks projects outwardly from and along an upper edge of the outwardly bowed surface of the next lower row of said planks, the thickness of said rail on each of said planks being substantially greater than the thickness of each said rabbet in each of said planks such that each of the flat inner surfaces of said planks which overlies another of said planks is tilted diagonally relative to said supporting structure to provide an airspace between each of said planks and said supporting surface.

11. The siding of claim 9 wherein said means comprises at least one groove formed in and along a flat inner surface portion of said planks.

* * * * *

UNITED STATES PATENT AND TRADEMARK OFFICE

CERTIFICATE OF CORRECTION

PATENT NO. : 5,423,153

DATED : June 13, 1995

INVENTOR(S) : Brent E. Woolems and Philip E. Woolems

It is certified that error appears in the above-indentified patent and that said Letters Patent is hereby corrected as shown below:

In the Abstract;
Line 5, "fiat" should read --flat--.

Col. 3, lines 25 and 43, "fiat" should read --flat--; Col. 4, line 42, "fiat" should read --flat--; and Col. 5, line 53, "fiat" should read --flat--.

Claim 1, col. 6, lines 12 and 19, "fiat" should read --flat--, and Claim 9, Col. 7, line 3, "fiat" should read --flat--.

Signed and Sealed this

Twenty-ninth Day of August, 1995

Bruce Lehman

*Attest:*

BRUCE LEHMAN

*Attesting Officer*

*Commissioner of Patents and Trademarks*